US012377328B2

(12) United States Patent
Heilman

(10) Patent No.: US 12,377,328 B2
(45) Date of Patent: Aug. 5, 2025

(54) GOLF PUTTER

(71) Applicant: Brad Heilman, Delta, OH (US)

(72) Inventor: Brad Heilman, Delta, OH (US)

( * ) Notice: Subject to any disclaimer, the term of this patent is extended or adjusted under 35 U.S.C. 154(b) by 893 days.

(21) Appl. No.: 17/392,663

(22) Filed: Aug. 3, 2021

(65) Prior Publication Data

US 2022/0040548 A1 Feb. 10, 2022

Related U.S. Application Data

(60) Provisional application No. 63/060,728, filed on Aug. 4, 2020.

(51) Int. Cl.

| | |
|---|---|
| ***A63B 60/20*** | (2015.01) |
| ***A63B 53/00*** | (2015.01) |
| ***A63B 53/04*** | (2015.01) |
| ***A63B 53/14*** | (2015.01) |

(52) U.S. Cl.

CPC ..... *A63B 60/20* (2015.10); *A63B 53/007* (2013.01); *A63B 53/0441* (2020.08); *A63B 53/14* (2013.01)

(58) Field of Classification Search

CPC ... A63B 60/20; A63B 53/007; A63B 53/0441; A63B 53/14

See application file for complete search history.

(56) References Cited

U.S. PATENT DOCUMENTS

| | | | | |
|---|---|---|---|---|
| 5,308,068 | A * | 5/1994 | Strand | A63B 60/00 473/251 |
| 6,213,890 | B1 | 4/2001 | Prince | |
| 6,663,499 | B2 | 12/2003 | Riseley | |
| 7,232,379 | B2 * | 6/2007 | Riseley | A63B 53/0487 473/340 |
| 10,905,928 | B2 * | 2/2021 | Sheldon | A63B 53/0487 |
| 2003/0100380 | A1 * | 5/2003 | D'Eath | A63B 60/02 473/340 |
| 2003/0207725 | A1 * | 11/2003 | Sanchez | A63B 53/065 473/340 |
| 2005/0130758 | A1 * | 6/2005 | Riseley | A63B 53/0487 473/251 |
| 2017/0209755 | A1 * | 7/2017 | Trahan | A63B 53/0487 |

* cited by examiner

*Primary Examiner* — Jeffrey S Vanderveen

(74) *Attorney, Agent, or Firm* — MacMillan, Sobanski & Todd, LLC

(57) ABSTRACT

A conventional length golf putter a first grip attached to the end of the shaft and a second grip attached to the shaft spaced from and below the first grip. The grips have matching frustoconical portions to create similar feel. The putter has a head with an alignment system to accommodate heel and toe putts.

8 Claims, 12 Drawing Sheets

GOLF PUTTER

REFERENCE TO RELATED APPLICATION

This Application claims the benefit of U.S. Provisional Application Ser. No. 63/060,728, filed on Aug. 4, 2020, the disclosure of which is fully incorporated by reference herein.

FIELD OF THE INVENTION

This invention relates to golf clubs. More specifically, this invention relates to putter gripping and aiming systems.

BACKGROUND OF THE INVENTION

Most conventional putters are between 32 and 42 inches in length with a single grip affixed to the shaft at one end and a putter head affixed at the opposite end.

Current single-grip conventional length putters do not provide adequate essential control of the putter face throughout the stroke and impact. They also do not provide an essential stable connection between the golfer's hands and the putter.

Many golfers would benefit by a more ergonomic designed double grip which allows the golfer to better control their putting stroke. Double grip putters provide an essential stable connection between the golfer's hands and the putter. Current putters do not provide similar feel for each grip, thus giving the golfer an awkward unmatched feeling between the hands much like when a person has 2 different shoes on their feet.

Many golfers would also benefit by a more innovative aiming system. Current putters do not provide aim lines to compensate for ball roll line deviation due to toe-up or toe-down putting.

SUMMARY OF THE INVENTION

This present invention is a double grip conventional length putter with similar feel portion tapered grips and rocking indicated canted aim line aiming system for heel and toe-putting. This invention provides the golfer the opportunity to orientate and better control the putter face throughout their putting stroke and to return it to the correct position at impact.

A three-point gripping hand position on the double grips forms a plane, the "feel triangle," which establishes a congruence between the hands and the putter face. The lower grip incorporates a similar feel portion to the upper grip. A canted aim line design for heel and toe-putting provides indicated canted aim lines to compensate for ball roll line deviation due to toe-up or toe-down putting allowing the golfer to better aim putts. Preferably, the putter has three aim grooves on the top of the putter, each groove having two edge aim lines. Corresponding three marks on the trailing edge of the putter that when viewed from directly above will align with the aim line groove or edge aim line groove to indicate which one the golfer should use.

Various additional features, advantages and objectives of the invention will become more readily apparent to those of ordinary skill in the art upon review of the following detailed descriptions of the preferred embodiments, taken in conjunction with the accompanying drawings.

DETAILED DESCRIPTION OF PREFERRED EMBODIMENTS

Figure 1:
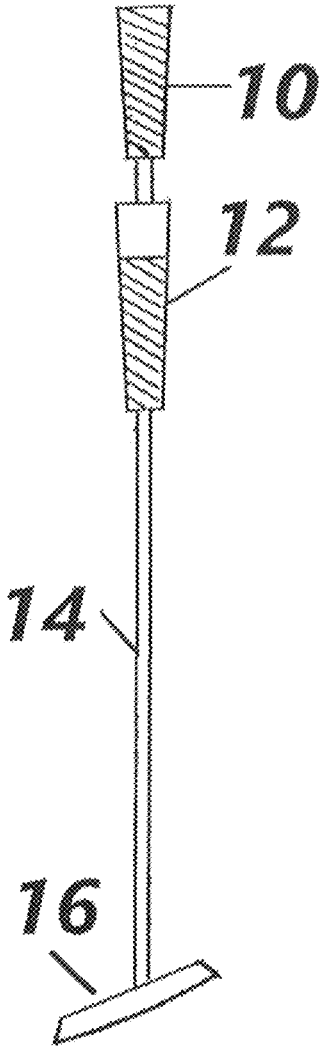
FIG. 1 is a front view of a double grip conventional length putter in accordance with the present invention.

FIG. 1 is a front view of a double grip conventional 38½ inch length putter 9 in accordance with the present invention. The putter includes a shaft 14, upper 10 and lower 12 similar feel portion grips being frustoconical about the shaft and a rocking putter head 16 having a semi-cylindrical arcuate bottom surface. The bottom surface may be flat or stepped, but the arcuate shape is preferred for the aiming system to be described herein. Most conventional length putters are between 32 inches and 42 inches in length, but generally no longer than 45 inches. This putter has a rocking head 16 to accommodate heel and or toe-putting. This putter's arced sole has a 12-inch radius. Putter soles may vary in arc. As will be described, this putter also incorporates an aiming system using sets of grooves 18*d*, 20*d*, 22*d*, edge aim lines 18*a*, 18*b*, 20*a*, 20*b*, 22*a*, 22*b* and flange 16*d* marks 18*c*, 20*c*, and 22*c* to adjust to toe-up and toe-down putter strikes.

Figure 2:
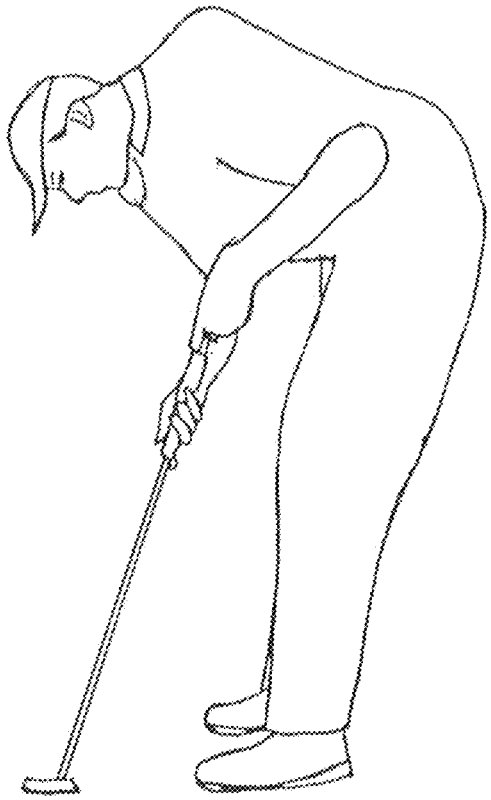
FIG. 2 is a perspective view showing a golfer demonstrating posture and gripping technique using the double grip conventional length putter of FIG. 1.

FIG. 2 illustrates the stance and gripping technique for the conventional length putter with 2 grips.

Figure 3:
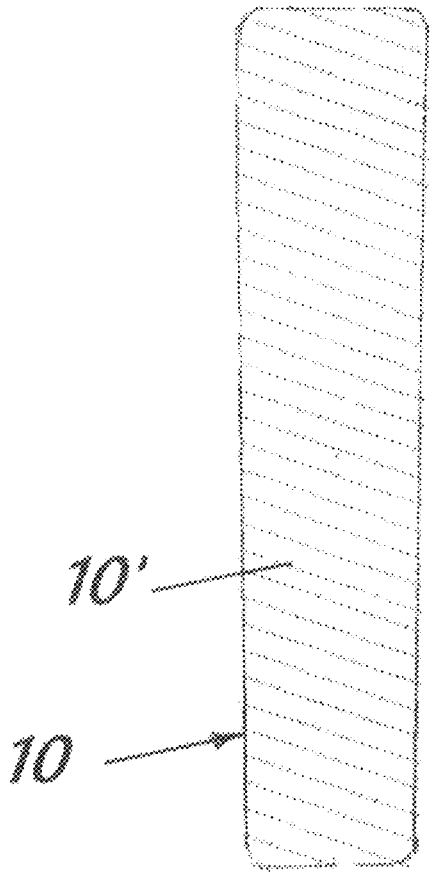
FIG. 3 is a front view of the upper grips of FIG. 1.
Figure 4:
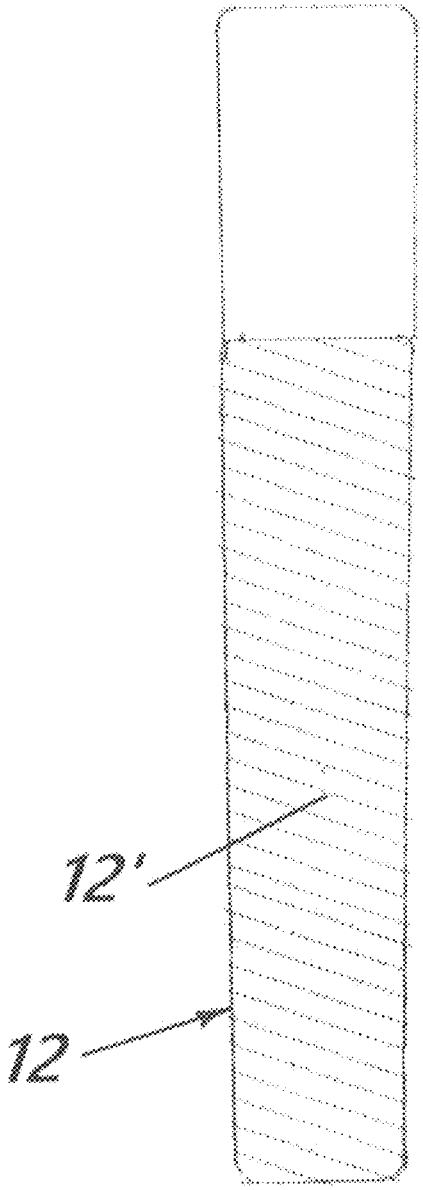
FIG. 4 is a front view of the lower grip of FIG. 1.

FIGS. 3 and 4 are views of the upper grip 10 and lower grip 12 with similar feel portions 10' and 12' indicated by shading; the upper grip 10 length being 5 inches, with an upper diameter of 1.125 inches tapering narrower to a 1 inch bottom diameter; the similar feel portion is shaded; the lower grip 12 length being 7 inches, with an upper diameter of 1.175 inches tapering narrower to a 1 inch bottom diameter, the similar feel portion is shaded. Of course, other grip lengths are within the scope of this invention.

Figure 5:
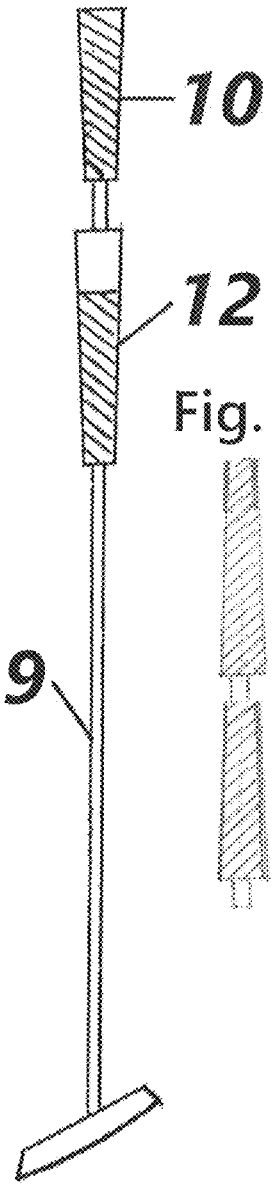
FIG. 5 is a perspective view of the placement of the grips of FIGS. 3 and 4 on a conventional length putter.
Figure 6:
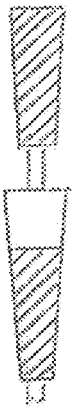
FIGS. 6-16 are views of alternative embodiments of the upper portion of the putter shaft of FIG. 5.
Figure 7:
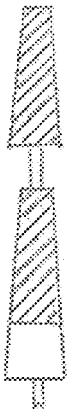
Figure 8:
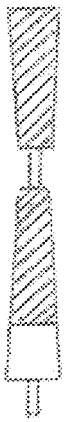
Figure 9:
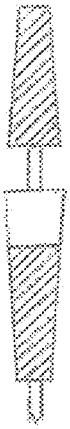
Figure 10:
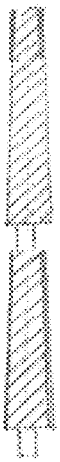
Figure 11:
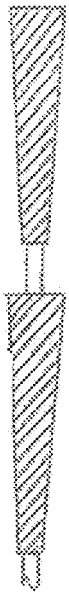
Figure 12:
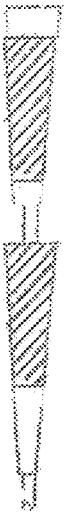
Figure 13:
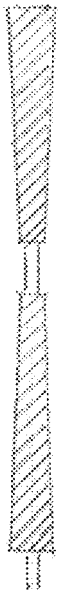
Figure 14:
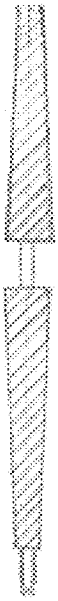
Figure 15:
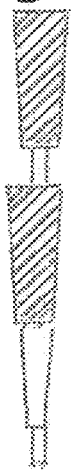
Figure 16:
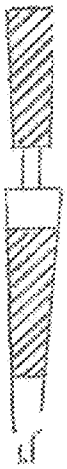

FIG. 5 is a view of the upper 10 and lower 12 grip placement on the putter. The 5-inch length upper grip 10 has a diameter of 1.125 inches tapering to 1 inch at the bottom, with the similar feel portion shaded, a grip separation of 1.5 inches and a 7-inch lower grip 12 with a diameter of 1.175 inches tapering to 1 inch at bottom with the similar feel portion shaded. The gap between the upper grip and the lower grip is 1.5 inches.

FIGS. 6-16 show the top or gripping portion of the putter of FIG. 5 having various grip style configurations with similar feel portions shaded. The shaded portions of each pair of grips of each figure are identical in size and shape. These grips provide an equal feel with each hand. The upper or top grips (as viewed in the figures) are 5 or more inches in length and the lower grips are 7 or more inches in length. Each double grip is frustoconical in shape and may taper in either or any direction, the lower grips having a similar feel section that matches the corresponding upper grips in diameter and taper providing the same feel for both hands. Shaded areas indicate the similar feel portions. Drawings are not all inclusive, other variations are possible, as the lengths of the grips may vary.

Figure 17:
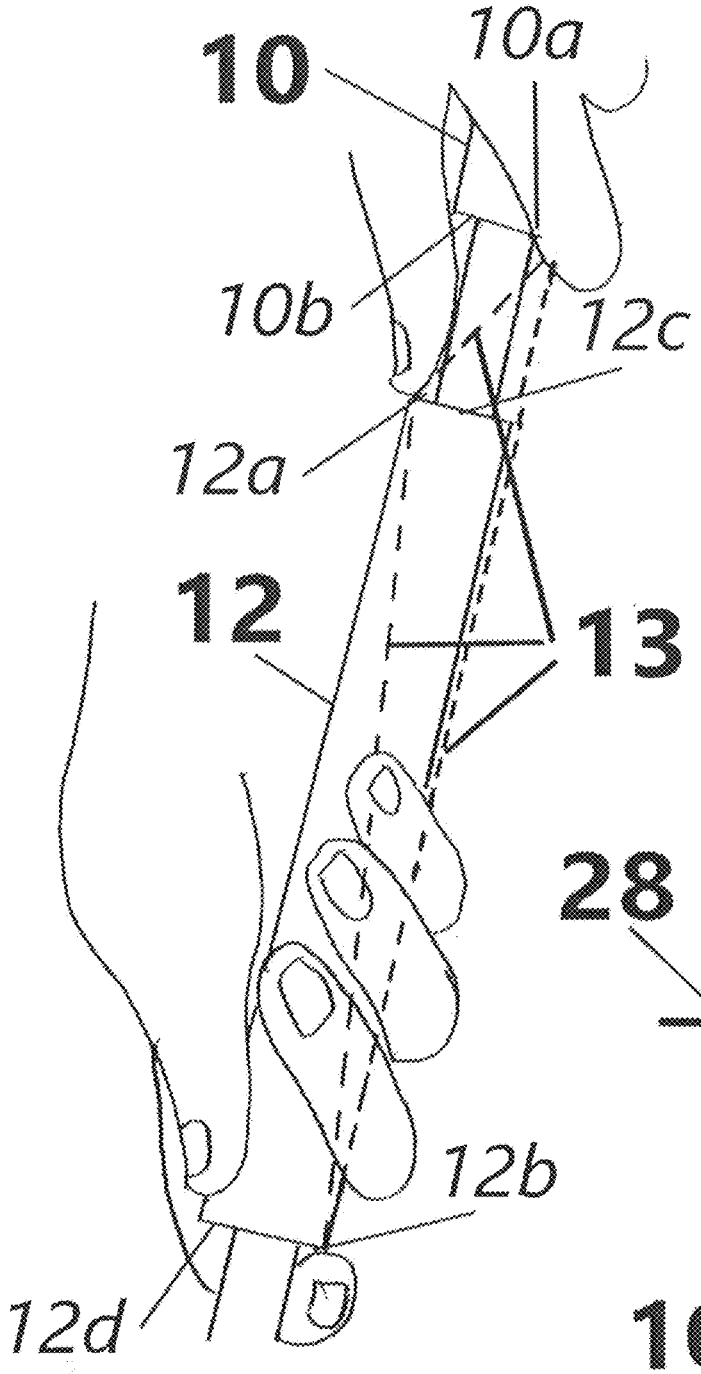
FIG. 17 is a perspective view of the three-point playing "feel triangle" gripping position.

FIG. 17 is a perspective view of the three-point playing "feel triangle" gripping position on a conventional length double grip putter. The 3-point playing "feel triangle" 13 is indicated by dotted lines. Grip 10 has a generally circular lower edge 10*b* while grip 12 has generally circular upper and lower edges 12*c* and 12*d*. This double grip conventional length putter design allows the golfer to place a fingertip or finger pad of each hand and the upper hand thumb tip on the ends of the grips 10, 12 thereby forming a "feel triangle" which helps them to orientate and better control the putter face 16*a* throughout their putting stroke and to return it to the correct position at impact. The "feel triangle" may be defined as the plane formed by the upper hand finger pressure point 10*a* against the inner bottom of the upper grip 10, the upper-hand thumb pressure point 12*a* against the outer top of the lower grip 12 and the lower hand finger pressure point 12*b* against the inner bottom of the lower grip 12. This is not possible with a single-gripped putter. Fingers other than the index fingers may be used to press against the ends of the grips 10, 12 along with the thumb to form the "feel triangle." This "feel triangle" relates to the putter face 16*a*.

Figure 18:
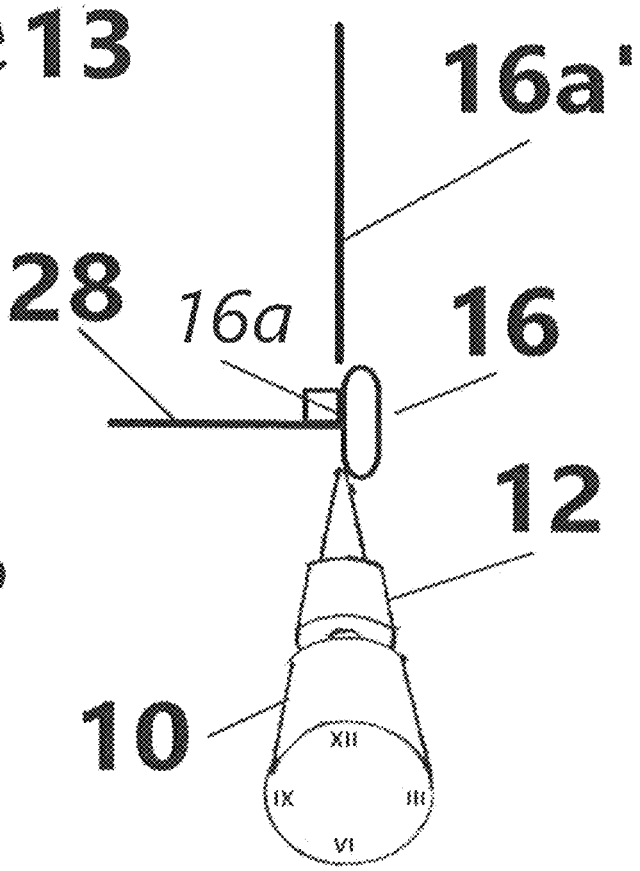
FIG. 18 is a perspective view of the "feel triangle" clock method.

FIG. 18 is a perspective view of the clock method for the pressure points 10*a*, 12*a*, 12*b* forming the three-point playing "feel triangle". The plane 16*a*' formed by these three points is generally parallel to the plane of the putter ball striking surface 16*a*. The line 28 of putt is 90 degrees perpendicular to the putter face 16*a*. The "feel triangle" plane and putter face 16*a* plane are congruent. The upper-hand index finger or other finger is placed at pressure point 10*a* at 6 o'clock, the upper-hand thumb is placed at pressure point 12*a* at 12 o'clock, and the lower-hand finger or other finger is placed at pressure point 12*b* at 6 o'clock.

Figure 19:
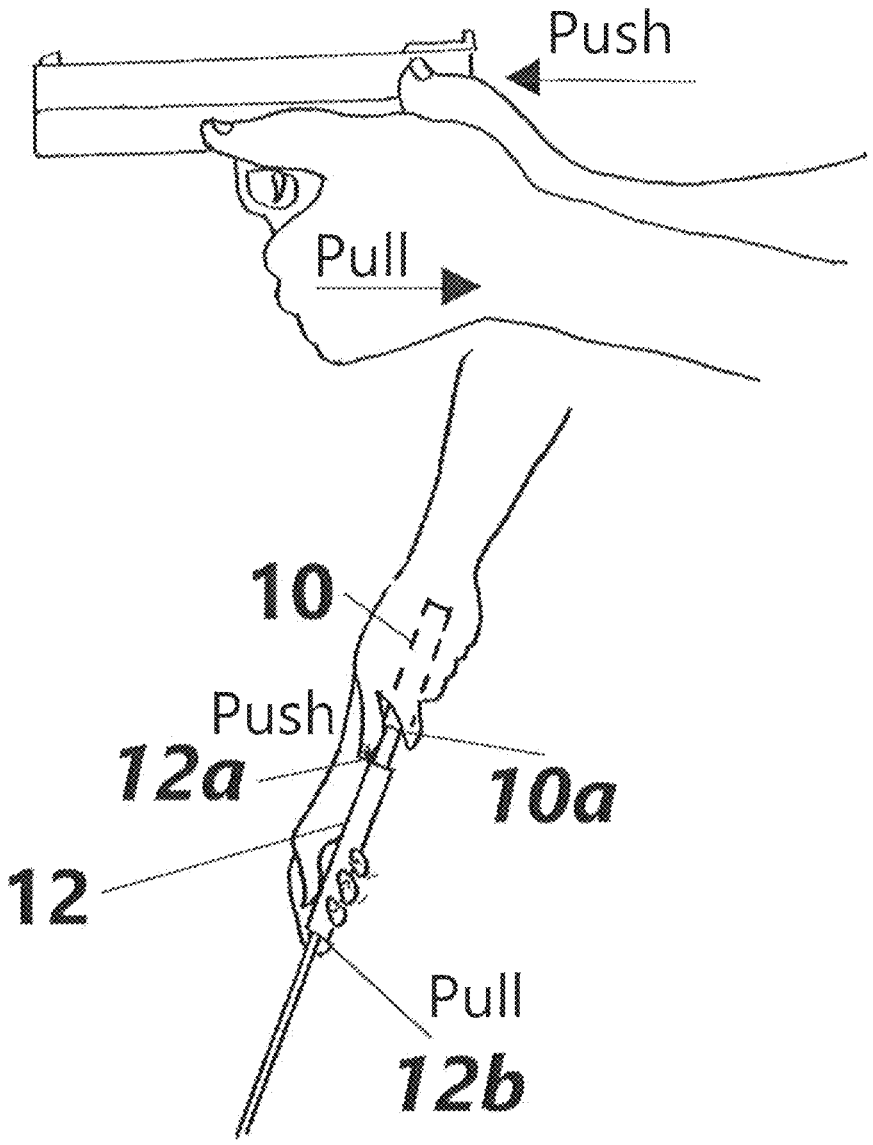
FIG. 19 is a perspective view of the "locked in" gripping technique.

FIG. 19 is a perspective view of the "locked in" gripping technique. With this conventional length double grip putter the golfer places both thumbs on the topside of the putter shaft in a downward pointing position. The golfer will use this technique to stabilize the putter during their stroke by pushing with the thumb of their upper hand against the top end 12*a* of the lower grip 12 while pulling with the index finger or other finger of the lower hand against the lower end 12*b* of the lower grip 12 to get a "locked in" secure and stable hold on the putter much like a person does to stabilize a pistol while shooting by pushing with one hand while pulling with the other hand. This technique is not possible with a double gripped long putter as with long putters the thumb of the upper hand points upward.

Figure 20:
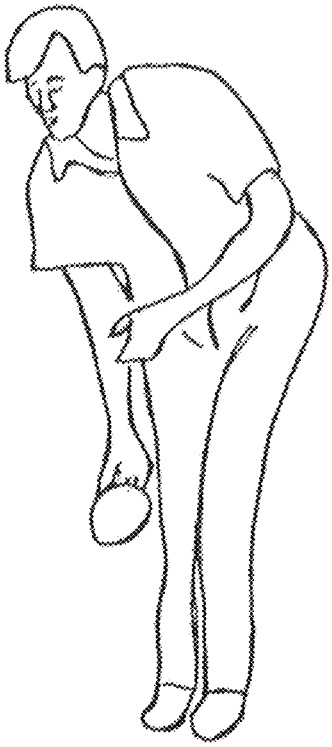
FIG. 20 is a perspective view of a lower hand more natural bowling position.
Figure 21:
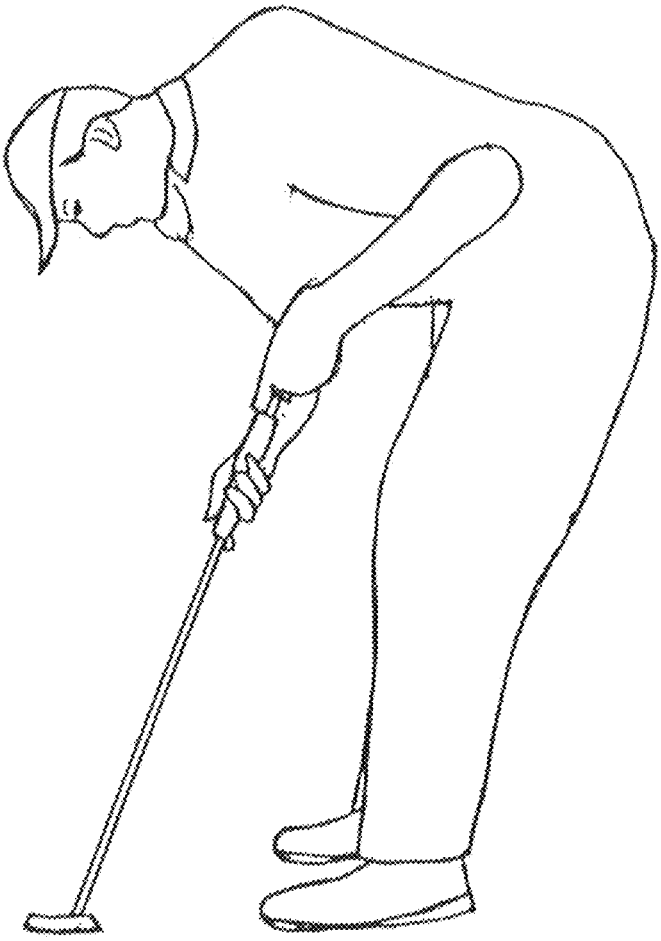
FIG. 21 is a perspective view of a golfer's lower hand position on the lower grip.

FIGS. 20 and 21 are perspective views of lower hand more natural bowling position. This invention is an improvement to the existing single grip putters. The construction of this double grip enables the golfer to grip the putter more naturally with the lower pushing hand being in a lower bowling type position which allows the pushing-hand to travel a longer distance during the stroke. This gives the golfer a better feel for the stroke and better control of distance. This technique is especially advantageous for golfers with diminished strength.

Figure 22:
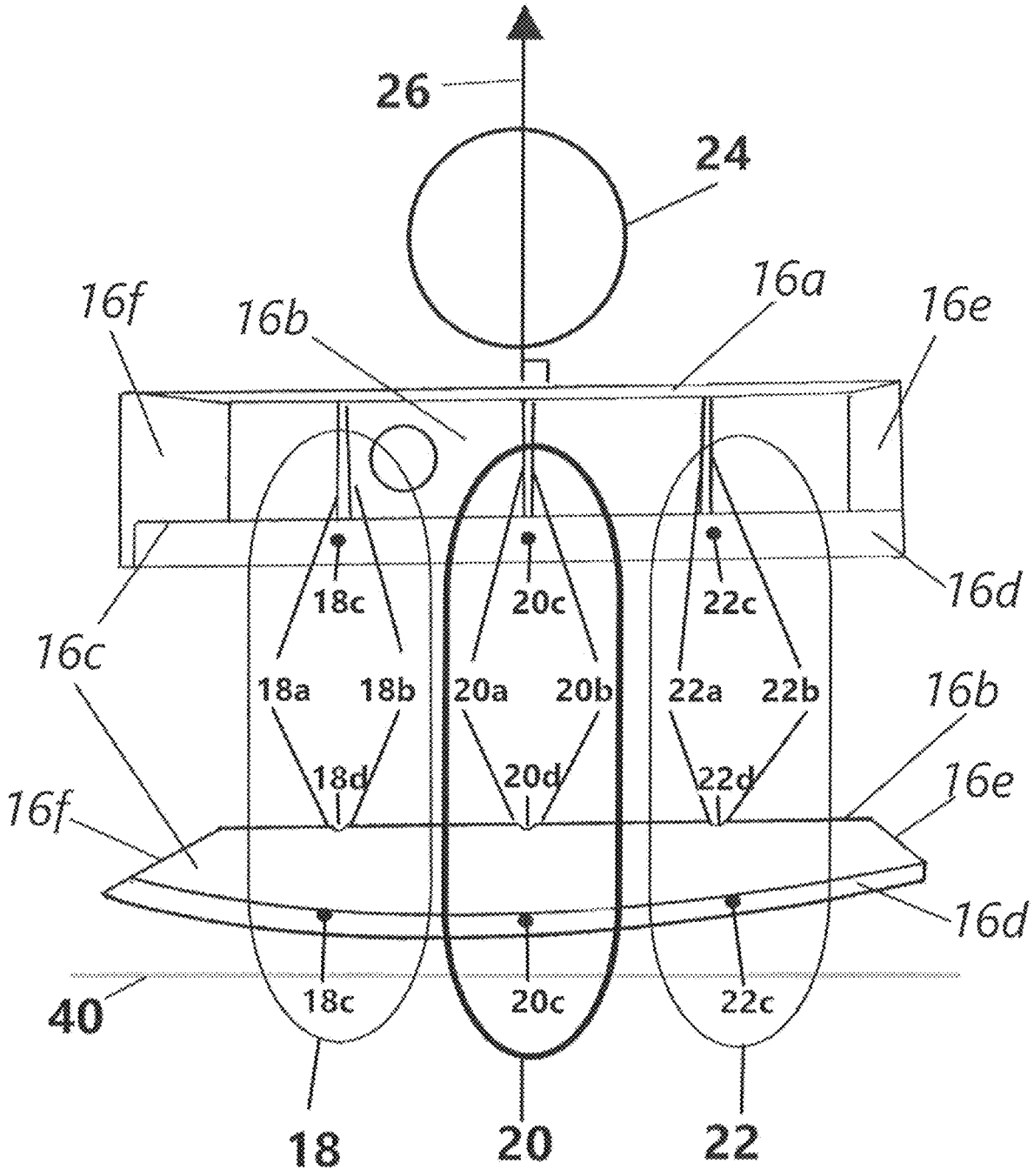
FIG. 22 is a top and rear view of a level position putter head at center ball strike address position with the putter head's canted aim lines highlighted.

Referring FIG. 22, rocking putter head 16 has a top surface 16*b* and a rear surface 16*c*. The head 16 is in a level position relative to the ground 40 and center ball strike address position. The rocking putter head 16 has canted aim line groups 18, 20, 22. This putter includes an aiming system that improves upon existing putters. Putter head 16 has three aim grooves 18*d*, 20*d*, 22*d* on the top surface 16*b* of the putter, each groove 18*d*, 20*d*, 22*d* having two edge aim lines 18*a*, 18*b*, 20*a*, 20*b*, 22*a*, 22*b*, respectively. When viewed from directly above, the aim lines align in a fashion with 3 marks 18*c*, 20*c*, 22*c* that are on the top of the trailing edge or flange 16*d* of the putter head 16. The 3 marks 18*c*, 20*c*, 22*c* on the flange 16*d* of the putter head 16 may be lines, grooves, marks, or holes and may have various shapes. The grooves 18*d*, 20*d*, 22*d* have edges which form aim lines 18*a*, 18*b*, 20*a*, 20*b*, 22*a*, 22*b* which aid in aiming the putter.

This level position putter head addresses the ball 24 using the center aiming group 20. Looking directly downward, the center flange mark 20*c* appears to be centered between the edge aim lines 20*a*, 20*b*. This produces a putter face 16*a* plane that is square to the target and a ball roll line 26 directly at the target.

When addressing the ball towards the toe 16*e* side of the putter face in this level position, the toe aiming group 22 may be used. Looking directly downward, the toe side flange mark 22*c* appears to be centered on the toe side edge aim line 22*b* of the toe side aim line groove 22*d*. This produces a putter face plane 16*a* that is square to the target and a ball roll line 26 directly at the target.

When addressing the ball towards the heel 16*f* side of putter face 16*a* in this level position, the heel aiming group 18 may be used. Looking directly downward, the heel side flange mark 18*c* appears to be centered on the heel side edge aim line 18*a* of the heel side aim line groove 18*d*. This will produce a putter face plane 16*a* that is square to the target and a ball roll line 26 directly at the target.

Figure 23:
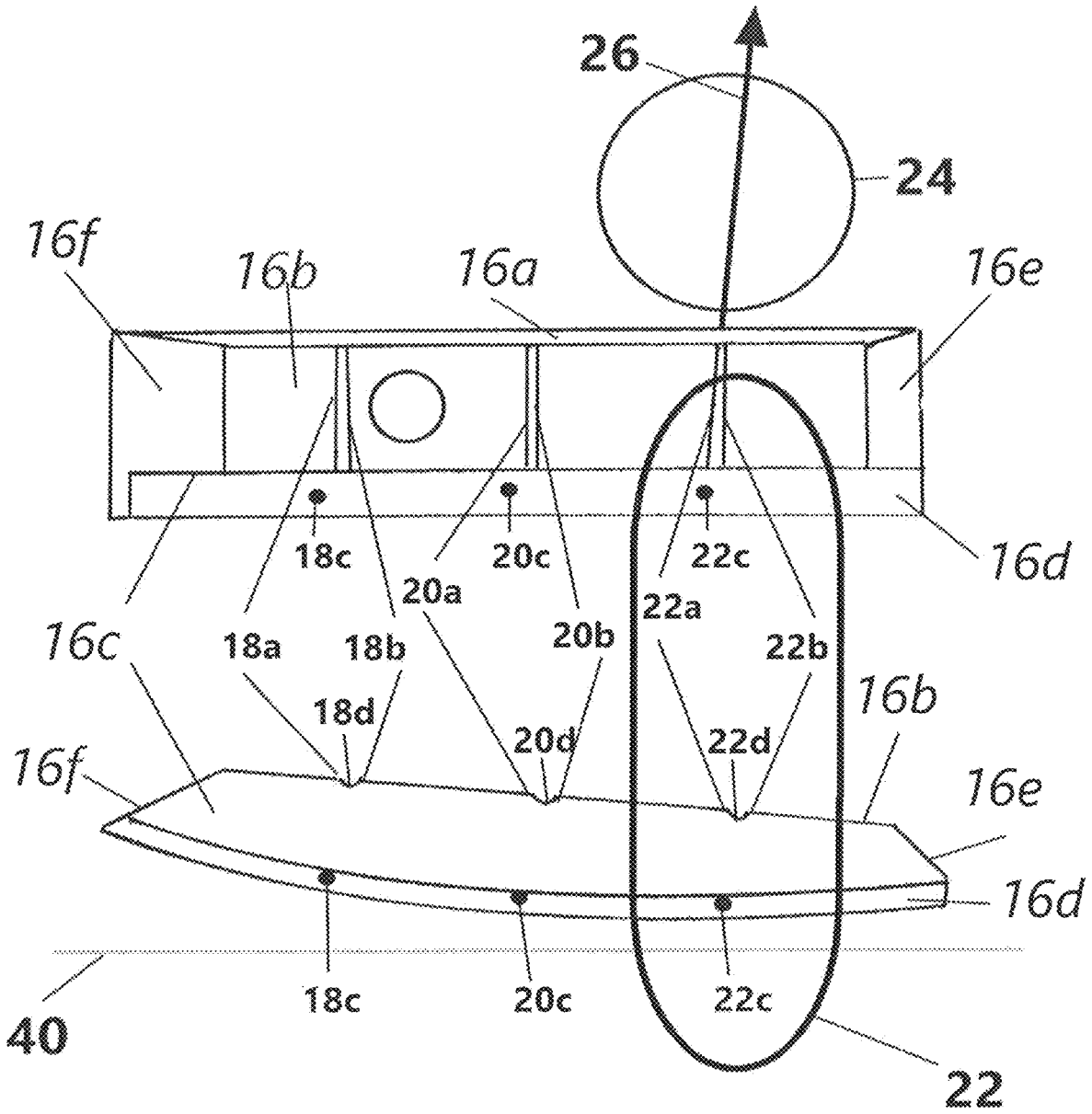
FIG. 23 is a top and rear view of a toe-down position putter head at toe ball strike address position with the rocking putter head's canted aim lines highlighted.
Figure 23A:
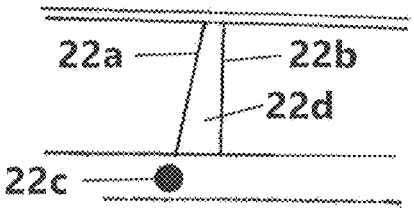
FIG. 23*a* is an expanded plan view of a top portion of the putter of FIG. 23.

Referring FIG. 23, rocking putter head 16 is oriented in a toe-down address position relative to the ground 40. There are situations where is it expedient for the golfer to strike a putt with the ball 24 is addressed towards the toe 16*e* of the putter head 16. This is called a toe-putt and the toe-side aim group 22 is used. This group 22 consists of an aim line groove 22*d*, a toe side edge aim line 22*b* that is square to the putter face 16*a*, a heel side edge aim line 22*a* that is canted 0.278 degrees toward toe side 16*e* of putter head 16, and a flange mark 22*c*. FIG. 23*a* shows an expanded view of the toe portion of the top surface 16*b* with canted edge 22*a* exaggerated for clarity.

Figure 30:
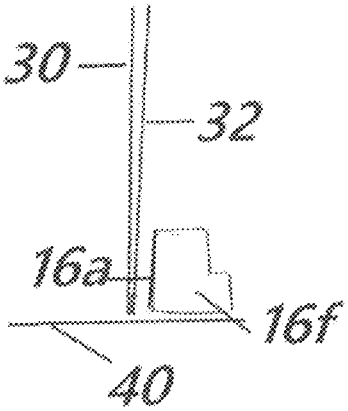
FIG. 30 is a heel end view of a putter head demonstrating the determination of a putter's loft.

As shown in FIG. 23, the putter head is rocked 5 degrees such that the bottom of the head is tangent to the ground 40 adjacent to flange mark 22*c*. The ball striking surface 16*a* has 5 degrees of loft (FIG. 30). Putters may have different lofts and may be designed for different degrees of rock.

Looking directly downward, the toe side flange mark 22*c* appears to be centered on the heel side edge aim line 22*b* of the toe side aim line groove 22*d*. This produces a putter face plane 16*a* that is square to the target and a ball roll line 26 directly at the target. This is accomplished because the heel side edge aim line 22*a* is canted 0.278 degrees toward the toe to compensate for the deviation caused by the 5-degree-loft putter face plane being rocked 5-degrees toward the toe side of the putter.

A ball 24 may also be addressed at the center of the putter face 16*a* while the putter head 16 is in the toe-down position. Looking directly downward the center flange mark 20*c* appears below the heel side edge aim line 20*a* of the center aim line groove 20*d*. This produces a putter face plane that is canted 0.278 degrees to the toe-side of the target and a ball roll line 26 that is 0.278 degrees to the toe side of the target. To compensate for this deviation the golfer may use the deviation mark 16*g* of 1 inch per 17 feet of putt length and adjust their aim accordingly.

Figure 24:
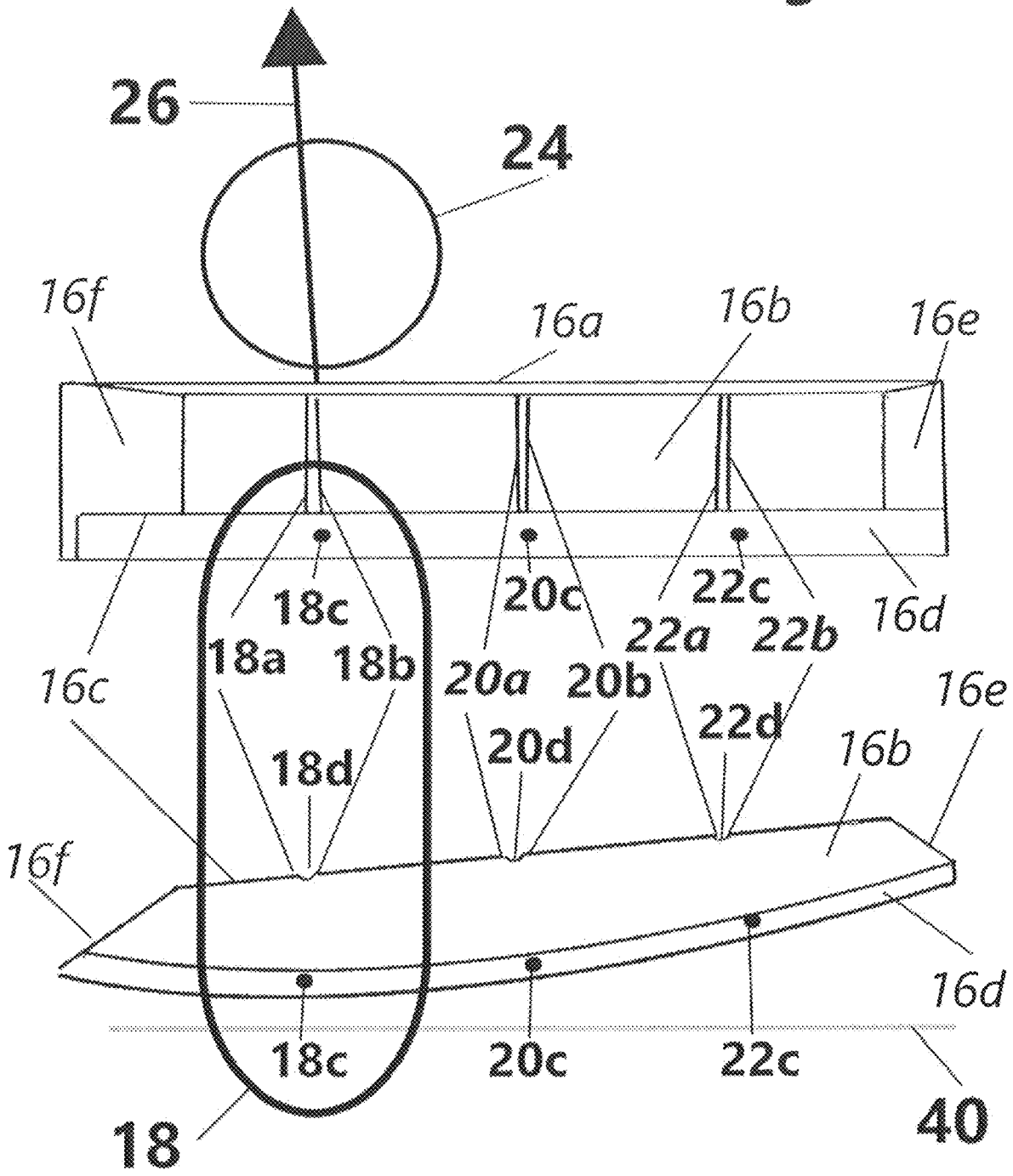
FIG. 24 is a top and rear view of a toe-up position putter head at heel ball strike address position with the rocking putter head's canted aim lines highlighted.

Referring to FIG. 24, rocking putter head 16 is oriented in a heel-down address position relative to the ground 40 with canted aim line design groups 18, 20, 22. There are situations where is it expedient for the golfer to strike the putt with the ball 24 addressed towards the heel 16*f* of the putter head 16. This is called a heel-putt. The heel-side aim group 18 is used. This group 18 consists of an aim line groove 18*d*, a heel side edge aim line 18*a* that is square to the putter face 16*a*, a toe side edge aim line 18*b* that is canted 0.278 degrees toward heel side 16*e* of putter head 16 and a flange mark 18*c*. The putter head 16 being rocked 5 degrees with 5 degrees of loft. Putters may have different lofts.

Looking directly downward the heel side flange mark 18*c* appears to be centered on the toe side edge aim line 18*b* of the toe side aim line groove 18*d*. This produces a putter face plane 16*a* that is square to the target and a ball roll line 26 directly at the target. This is accomplished because the toe side edge aim line 18*b* is canted 0.278 degrees toward the heel side of the putter to compensate for the deviation caused by the 5-degree-loft putter face plane 16*a* being rocked 5-degrees toward the heel.

A ball 24 may also be addressed at the center of the putter face 16*a* while the putter head 16 is in the heel-down position. Looking directly downward the center flange mark 20*c* appears below the toe side edge aim line 20*b* of the center aim line groove 20*d*. This produces a putter face plane that is canted 0.278 degrees to the heel-side of the target and a ball roll line 26 that is 0.278 degrees to the heel side of the target. To compensate for this deviation the golfer may use the deviation mark 16*g* of 1 inch per 17 feet of putt length and adjust their aim accordingly.

FIGS. 25, 26, 27, 28, 29, 30 illustrate the formula for the ball roll line 26 deviation. The formula for the ball roll line 26 deviation is Y(X/90) where X=degrees of loft and Y=degrees of putter tilt from horizontal line 40.

Then the formula to determine how many inches (X) of putt the ball roll line 26 will deviate from the level putter face 16*a* ball roll line 26 by approximately 1 inch is X=1/sine of the angle of deviation. The angle of a putter ball roll line 26 deviation at 5 degrees of tilt is 0.278 degrees. The sine of 0.278 degrees is 0.00485199628. Therefore, the number of inches of deviation is 1/0.00485199628=206 inches which is approximately 17 feet, or 204 inches. Therefore, at 17 feet the ball roll line 26 deviates from the target line 32 by 1 inch. This deviation is marked on the putter as 1:17 and is referred to as the deviation mark 16*g*.

Figure 25:
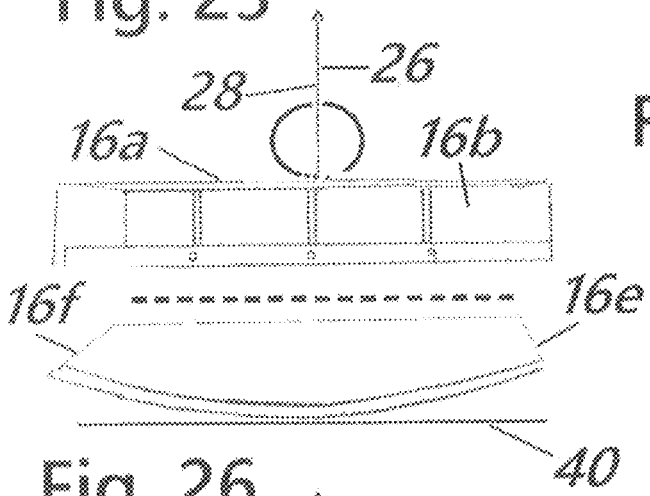
FIGS. 25 is a top and rear view of a level position putter head at center face address position demonstrating the ball roll line deviation from the target line.

FIG. 25 is a perspective view of a top 16*b* and rear 16*c* surfaces of a level position putter head 16 at center face address position demonstrating the ball roll line 26 deviation from the target line 28. The deviation for a level position putter head is 0. The target line and the ball roll line being the same.

Figure 26:
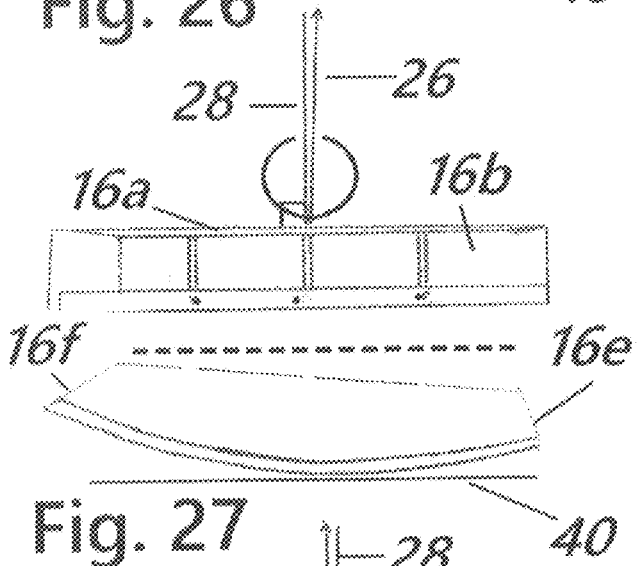
FIG. 26 is a top and rear view of a toe-down position putter head at center face address position demonstrating the ball roll line deviation from the target line.

FIG. 26 shows the top 16*b* and rear 16*c* surfaces toe-down position putter head 16 at center face address position demonstrating the ball roll line 26 deviation from the target line 28. The deviation of the ball roll line 26 from the target line 28 for a toe-down position putter head 16 rocked 5 degrees with 5 degrees of loft is 0.278 degrees towards the toe 16*e* side.

Figure 27:
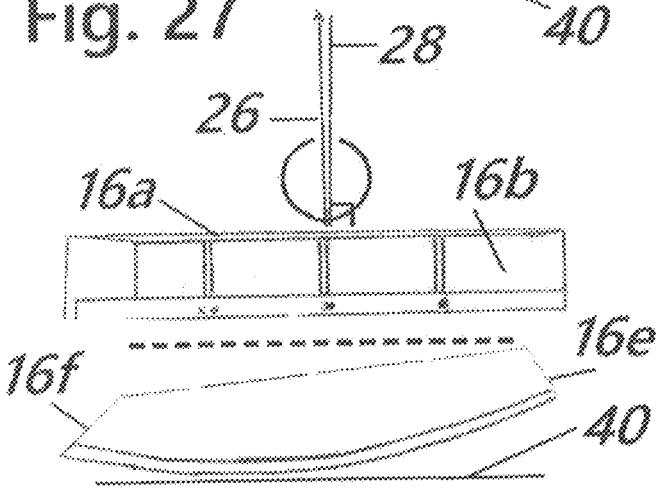
FIG. 27 is a top and rear view of a toe-up position putter head at center face address position demonstrating the ball roll line deviation from the target line.

FIG. 27 shows the top 16*b* and rear 16*c* surfaces of a toe-up position putter head 16 at center face address position demonstrating the ball roll line 26 deviation from the target line 28. The deviation of the ball roll line 26 from the target line 28 for a toe-up position putter head 16 rocked 5 degrees with 5 degrees of loft is 0.278 degrees towards the heel 16*f* side.

Figure 28:
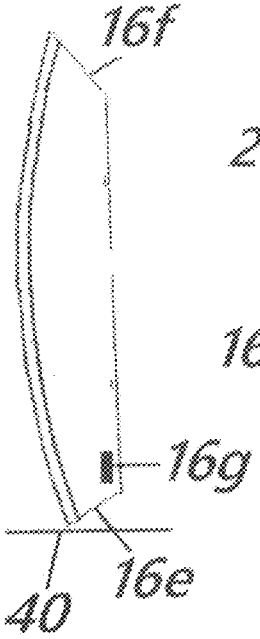
FIG. 28 is a rear view of a putter head rocked 90 degrees in a toe-down position.
Figure 29:
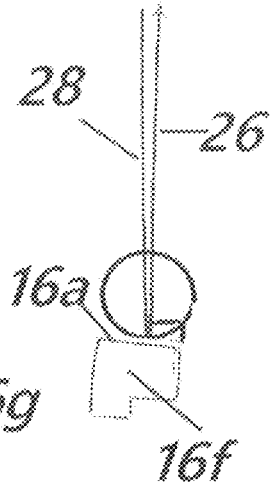
FIG. 29 is a heel end view of a level position putter head rotated 90 degrees clockwise addressing a golf ball demonstrating the ball roll line deviation from the target line.

FIG. 28 shows a rear view of a putter head rocked 90 degrees relative to the ground 40 in a toe-down position. FIG. 29 is a heel end view of a level position putter head rotated 90 degrees clockwise addressing a golf ball demonstrating the ball roll line 26 deviation from the target line 28. The deviation of the ball roll line 26 equals the loft of the putter. The loft of this presentation is 5 degrees. Putter lofts typically vary between 2 and 6 degrees. Other variations of this putter may have a different loft.

To determine the degree of deviation between the ball roll line 26 and the target line 28 the putter is rocked to a 90-degree toe-down position. The 90-degree toe-down position has a 5-degree deviation in ball roll line. This causes the ball roll line 26 to deviate from the level putter target line by the degrees of loft of the putter face. The degrees of deviation in the ball roll line from the level putter target line per degree of rock is the loft of the putter divided by 90 degrees. For this presentation, the putter face has 5 degrees of loft. The formula for determining the deviation of the ball roll line from the level position putter head target line per degree of rock is y/90=x. y being the loft of the putter and x being the degrees of deviation per degree of rock. The formula for this presentation is 5/90=0.0555 . . . The formula for finding the degrees of deviation of ball roll line from level position putter target line at 5 degrees of rock is z(y/90), with z being the degrees of rock and y being the loft of the putter. The formula for this presentation is 5(5/90)=0.278. The cant of this presentation aim lines is 0.278 degrees.

FIG. 30 shows the heel 16*f* view of a putter head demonstrating the determination of a putter's loft. The deviation of the loft line 32 (which is parallel to the ball striking surface) from the vertical line 30 (which is perpendicular to the ground) is the loft of the putter. In this embodiment, the loft is 5 degrees.

Figure 31:
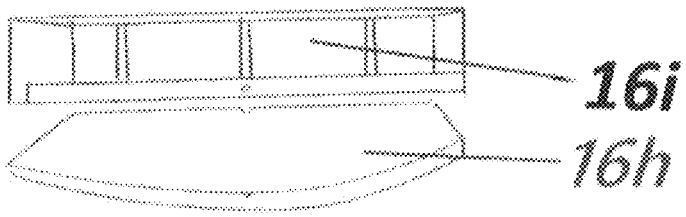
FIG. 31 is a top and rear view of a putter head with canted center edge aim lines and canted heal and toe inner edge aim lines.

FIG. 31 shows and alternative embodiment of putter head 16 having a top surface 16*i* and a rear surface 16*h* with canted center edge aim lines and canted heal and toe inner edge aim lines.

Figure 32:
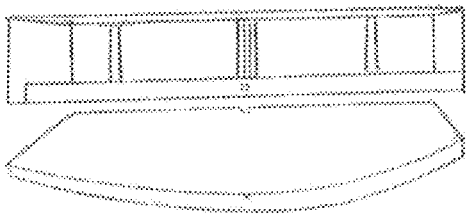
FIG. 32 is a top and rear view of a putter head with double center aim grooves with canted outside edge aim lines and canted heal and toe inner edge aim lines.

Other variations may be possible. FIG. 32 shows a putter head with double center aim grooves with canted outside edge aim lines and canted heal and toe inner edge aim lines.

Figure 33:
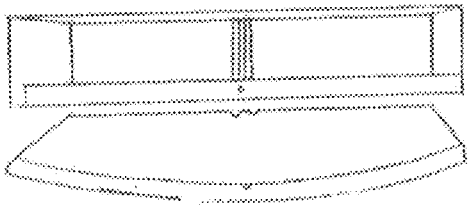
FIG. 33 is a top and rear view of a putter head with canted double center aim grooves with canted outside edge lines.

FIG. 33 shows a putter head with canted double center aim grooves with canted out-side edge lines.

Figure 34:
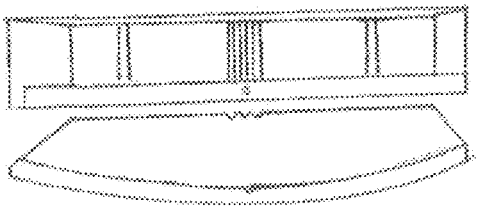
FIG. 34 is a top and rear view of a putter head with triple center aim grooves with square center groove with square edge aim lines, canted toe side and heel side grooves with canted inside and outside edge aim lines.

FIG. 34 shows a putter head with triple center aim grooves with square center groove with square edge aim lines, canted toe side and heel side groove with canted inside and outside edge aim lines.

Figure 35:
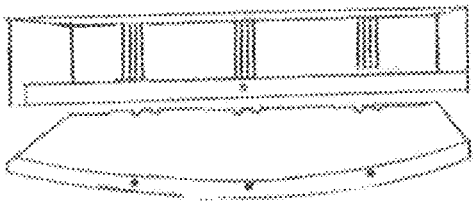
FIG. 35 is a top and rear view of a putter head with double center aim grooves with canted outside edge aim lines. The heel and toe inner grooves with canted inside and outside edge aim lines.

FIG. 35 shows a putter head with double center aim grooves with canted outside edge aim lines. The heel and toe inner grooves with canted inside and outside edge aim lines.

Figure 36:
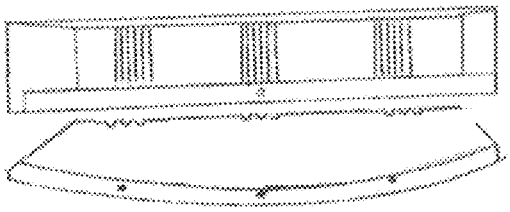
FIG. 36 is a top and rear view of a putter head with triple center, heel and toe aim grooves with the outside and inside grooves with canted outside and inside edge aim lines.
Figure 37:
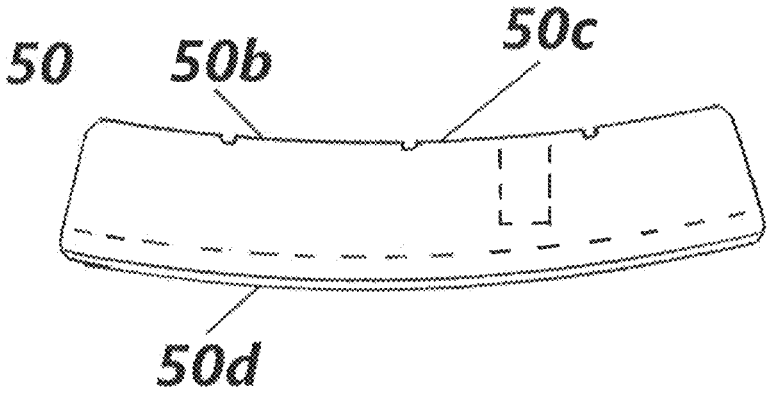
FIG. 37 is a front view of an alternative putter head design.
Figure 40:
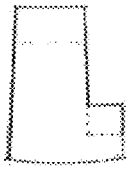
FIG. 40 is a heel end view of the putter head of FIG. 37.
Figure 38:
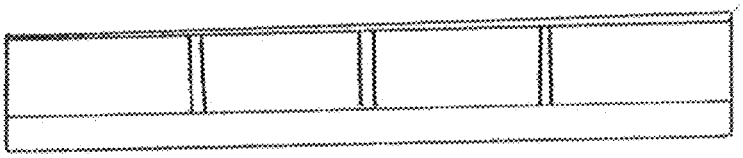
FIG. 38 is a top view of the putter head of FIG. 37.
Figure 39:
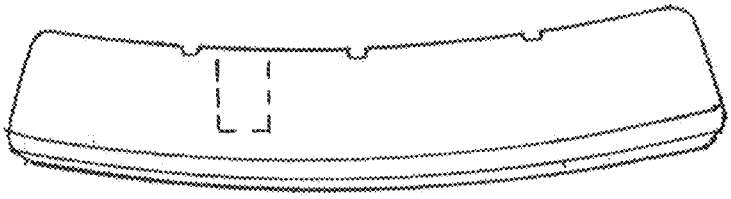
FIG. 39 is a rear view of the putter head of FIG. 37.

FIG. 36 shows a putter head with triple center, heel and toe aim grooves with the outside and inside grooves with canted outside and inside edge aim lines. The aim lines may be painted, etched, or marked in some other fashion.

FIGS. 37-40 show an alternative embodiment of the present invention. Putter head 50 is similar in all aspects to putter head 16 with the exception of an arcuate top surface 50*b*. The sole or bottom surface 50*d* is semi cylindrical with an arc of 12 degrees. The arc of the top surface 50*c* is also 12 degrees to match the bottom surface.

The descriptions of specific embodiments of the invention herein are intended to be illustrative and not restrictive. The invention may be practiced otherwise than as specifically explained and illustrated without departing from its spirit or scope as defined by the appended claims.

I claim:

1. A golf club putter comprising an elongated shaft and a head attached to the shaft, the head having a heel portion and a toe portion, ball striking face, a top surface, a bottom surface, and a bottom surface flange extending away from the striking face, the top surface having an alignment line adjacent the toe or heel portion, and a flange mark on the flange corresponding to the alignment line, the flange mark below the alignment line when the bottom surface is on the ground, wherein the ball striking surface is generally planar and the alignment line is skewed relative to a plane perpendicular to the ball striking face.

2. A putter as defined in claim 1 wherein the bottom surface is arcuate.

3. A putter as defined in claim 1 wherein the plane of the ball striking face is non-parallel to the shaft, thereby creating a loft angle relative to a vertical plane, and wherein the alignment line deviates from a line perpendicular to the striking face by Y (X/90), where X is the loft angle of the ball striking face and Y is the angle of tilt of the head relative to horizontal.

4. A putter head as defined in claim 3 wherein the alignment line deviates from a line perpendicular to the striking face by about 1 inch at 17 feet.

5. A putter as defined in claim 3 wherein the distance Z that the ball roll line will deviate from the aim line equals [1/sine Y (X/90)]/12, where X is the loft angle of the ball striking face relative to vertical and Y is the angle of tilt of the head relative to horizontal.

6. A putter as defined in claim 3 wherein the alignment line is adjacent the toe portion.

7. A putter as defined in claim 3 wherein the alignment line is adjacent the heel portion.

8. A putter as defined in claim 3 wherein the alignment line is adjacent the heel portion, and further comprising a second alignment line adjacent the toe portion.

* * * * *